US007434901B2

(12) United States Patent
Koh et al.

(10) Patent No.: US 7,434,901 B2
(45) Date of Patent: Oct. 14, 2008

(54) APPARATUS FOR ADJUSTING A SPACING BETWEEN A PRINTHEAD AND A PRINT MEDIUM IN A PRINTER

(75) Inventors: Seng San Koh, Singapore (SG); Manish Agarwal, Singapore (SG); Cherng Linn Teo, Singapore (SG); Rhea Patricia Liem, Singapore (SG); Michael Nordlund, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 316 days.

(21) Appl. No.: 11/176,045

(22) Filed: Jul. 7, 2005

(65) Prior Publication Data

US 2007/0008352 A1 Jan. 11, 2007

(51) Int. Cl.
*B41J 25/308* (2006.01)

(52) U.S. Cl. ..... 347/8; 347/104; 347/101

(58) Field of Classification Search ..... 347/8, 347/37, 101, 104, 19, 55–60; 400/55
See application file for complete search history.

(56) References Cited

U.S. PATENT DOCUMENTS 5,393,151 A 2/1995 Martin et al.
5,820,283 A 10/1998 Sunada et al.
6,024,497 A * 2/2000 Leibman ..... 384/428
6,027,264 A 2/2000 Maher et al.
6,382,752 B1 5/2002 Riou
6,386,663 B1 5/2002 Olson
6,394,568 B1 * 5/2002 Menendez ..... 347/8
6,406,110 B1 6/2002 Ahne et al.
6,543,868 B2 4/2003 Cooper et al.
6,604,801 B2 8/2003 Park
6,629,787 B2 10/2003 Lee et al.
6,666,537 B1 * 12/2003 Kelley et al. ..... 347/8
2002/0089556 A1 7/2002 Riou
2003/0071867 A1 4/2003 Hinojosa et al.
2004/0017410 A1 1/2004 Kim

* cited by examiner

*Primary Examiner*—Matthew Luu
*Assistant Examiner*—Henok Legesse

(57) ABSTRACT

An apparatus for adjusting a spacing between a printhead and a print medium in a printer is provided. The printhead is mounted in a carriage which is slidable along a guiding rod. The apparatus includes a first and second assembly for adjusting a position of a first and second portion of the carriage, respectively. The second assembly includes a camshaft attached to and slidable with respect to the carriage, one or more cams attached to the camshaft, and a bushing member. A first surface of the bushing member abuts a predefined profile of the cam, and a second surface of the bushing member abuts the guiding rod. The sliding of the camshaft with respect to the carriage causes a distance between the bushing member and the camshaft to vary according to the predefined profile of the cam. Accordingly, the spacing between the printhead and the print medium is adjusted.

5 Claims, 13 Drawing Sheets

APPARATUS FOR ADJUSTING A SPACING BETWEEN A PRINTHEAD AND A PRINT MEDIUM IN A PRINTER

FIELD OF THE INVENTION

The invention relates generally to printers, and more particularly to an apparatus for adjusting a spacing between a printhead and a print medium in a printer.

BACKGROUND OF THE INVENTION

A printer, in particular an inkjet printer, generally includes one or more ink cartridges. Each ink cartridge has a printhead with ink nozzles. Ink droplets are expelled through the ink nozzles onto a print medium advanced through the printer. The ink cartridges are normally mounted in a carriage of the printer. The carriage is movable across a width of the print medium by sliding along a guiding rod. Images are formed on the print medium by controlling the movement of the carriage, and hence the ink cartridges, across the print medium and expelling ink droplets from the ink nozzles onto the print medium advanced through the printer accordingly.

The quality of the images formed depends on the trajectory of the ink droplets from the ink nozzles to the print medium. One of the factors affecting the trajectory of the ink droplets is the spacing between the printhead and the print medium. This spacing is commonly referred as the Pen-to-Paper Spacing (PPS).

For high quality images, the PPS should be minimized. This is because as the PPS increases, the trajectory of the ink droplets changes and becomes difficult to predict. Moreover, the ink droplets also start to spread out when the PPS is large, resulting in a "spray" effect. The "spray" effect is due to the forming of secondary ink droplets from the primary ink droplet. These secondary droplets introduce noise to the images form, and hence, reduce image quality.

Although the PPS should be minimized to obtain high quality images, it should not be too small such that it contacts the print medium. In other words, sufficient spacing between the printhead and the print medium should be ensured to prevent smearing of images on the print medium or damage to the printhead as a result of the print medium contacting the printhead. Contacting of the printhead by the print medium may be caused by the upward buckling of the print medium toward the ink nozzles due to the absorption of ink in the print medium. Another possibility of contacting the printhead by the print medium may be due to the use of a thick print medium. Therefore, in order to obtain the highest quality of images, an optimum PPS should be maintained.

Print medium includes paper, cardboard and Compact Disc (CD), all of which have different thicknesses. Therefore, the PPS in the printer changes when printing on different types of print medium with different thicknesses. Printers normally have mechanisms to provide different PPS settings for printing on different types of print medium.

The ink cartridge is normally mounted in the carriage in such a way that the printhead faces the print medium at a front portion of the carriage. The carriage is also normally mounted at its central portion on the guiding rod. For such a design arrangement, the PPS in the printer can be increased by pushing a rear portion of the carriage downwards. Since the carriage is mounted on the guiding rod at its central portion, the front portion of the carriage is tilted upwards. Therefore, the PPS in the printer is increased. However, when the front of the carriage is tilted upwards, an angle between the printhead and the print medium (theta X) increases. The increase of theta X leads to high dot placement error.

In order to maintain theta X at zero, i.e. to maintain the printhead to be parallel to the print medium, the carriage may be mounted on two guiding rods at both the rear portion and the front portion. In this case, the printhead of the ink cartridge is located at the central portion of the carriage. To increase the PPS, both the guiding rods are lifted. By lifting the two guiding rods by the same amount, the PPS can be increased with theta X maintained at zero. However, this dual guiding rod design results in the printer to be high in cost, and also requires user intervention for lifting the carriage.

It is desirable to have a low cost mechanism for providing different PPS settings for different print medium and also able to maintain zero theta X at the different PPS settings.

SUMMARY OF THE INVENTION

An apparatus for adjusting a spacing between a printhead and a print medium in a printer is provided. The printhead is mounted in a carriage which is slidable along a guiding rod. The apparatus includes a first and second assembly for adjusting a position of a first and second portion of the carriage, respectively. The second assembly includes a camshaft attached to and slidable with respect to the carriage, one or more cams attached to the camshaft, and a bushing member. A first surface of the bushing member abuts a predefined profile of the cam, and a second surface of the bushing member abuts the guiding rod. The sliding of the camshaft with respect to the carriage causes a distance between the bushing member and the camshaft to vary according to the predefined profile of the cam. Accordingly, the spacing between the printhead and the print medium is adjusted.

BRIEF DESCRIPTION OF THE DRAWINGS

The embodiments of the invention will be better understood in view of the following drawings and the detailed description.

DETAILED DESCRIPTION OF THE INVENTION

Figure 1:
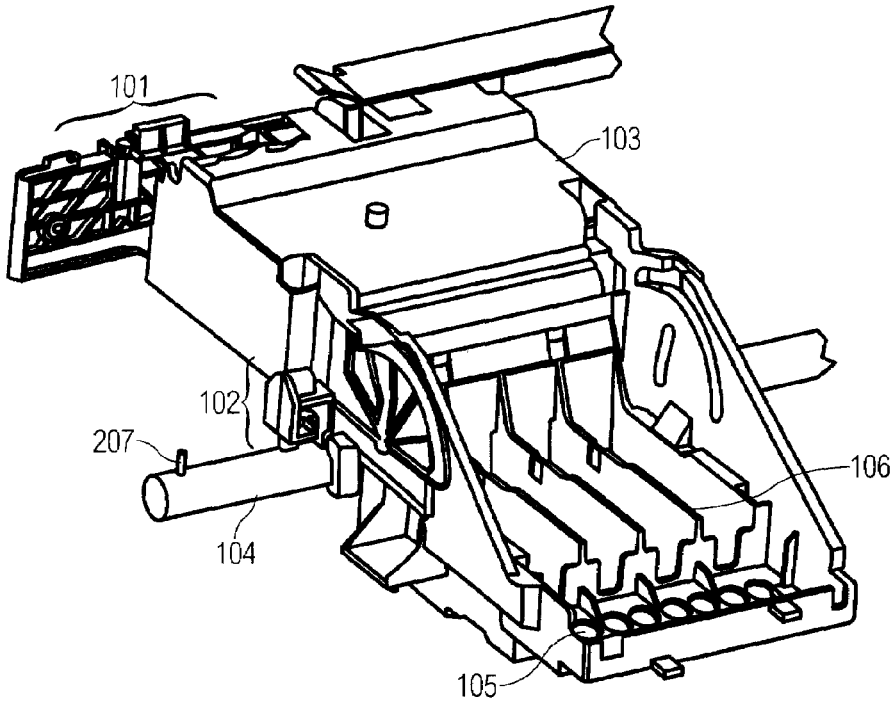
FIG. 1 shows a printer carriage having a first assembly and a second assembly for adjusting a vertical position of the printer carriage in a printer according to an embodiment.

FIG. 1 shows a printer carriage 103 having a first assembly 101 and a second assembly 102 for adjusting a vertical position of the printer carriage 103 in a printer according to an embodiment. The first assembly 101 controls the vertical position of a rear portion of the carriage 103, and the second assembly 102 controls the vertical position of a central portion of the carriage 103. Therefore, by lifting or lowering the rear and central portions of the carriage 103, the vertical position of the carriage 103 can be adjusted without being tilted (i.e. theta X is maintained at zero). The structure and operation of the first assembly 101 and the second assembly 102 will be described in detail later.

A front portion 106 of the carriage 103 is adapted to house an ink cartridge (not shown). When the ink cartridge is mounted in the carriage 103, the printhead of the ink cartridge faces in a downward direction and aligns with a printhead surface 105 of the carriage 103. The carriage 103 is mounted on a guiding rod 104. During a printing process, the carriage 103 moves along the guiding rod 104 and the ink cartridge ejects ink droplets onto a print medium.

The spacing between the printhead surface 105 of the carriage 103 and the print medium, i.e. the Pen-to-Paper Spacing (PPS), is preferably maintained at an optimum distance for forming high quality images. When print medium having different thicknesses are fed into the printer, the PPS changes. By adjusting the vertical position of the carriage 103 in the printer according to the type of print medium, the optimum distance for PPS can be maintained.

Figure 2A:
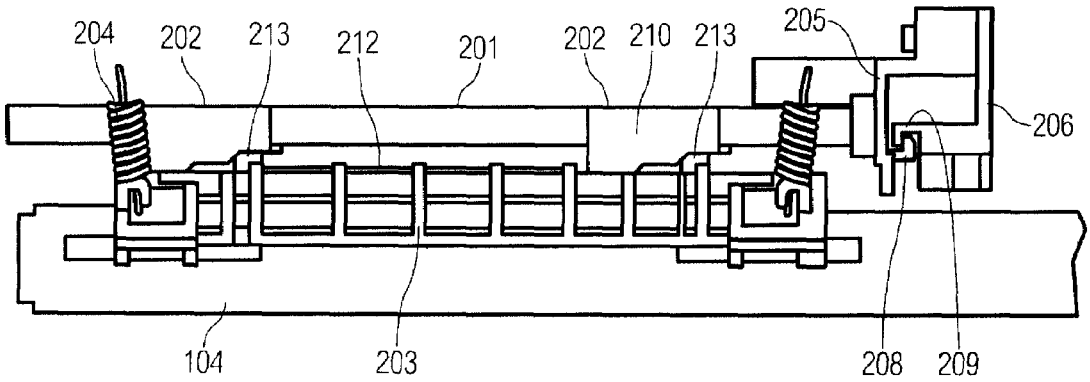
FIG. 2*a* and FIG. 2*b* show the cross-sectional views of the second assembly according to an embodiment.
Figure 2B:
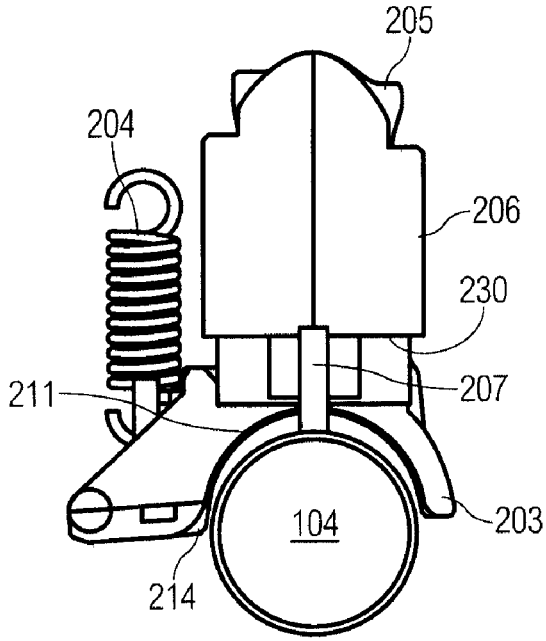

FIGS. 2*a* and 2*b* show the cross-sectional views of the second assembly 102 according to an embodiment. The second assembly 102 includes a camshaft 201, two cams 202 attached to the camshaft 201, a bushing member 203, two protruding members 213, two springs 204, a connecting plate 205 and a pin engaging means 206. The guiding rod 104 also includes an activation pin 207. The activation pin 207 protrudes from a first end of the guiding rod 104.

Figure 2C:
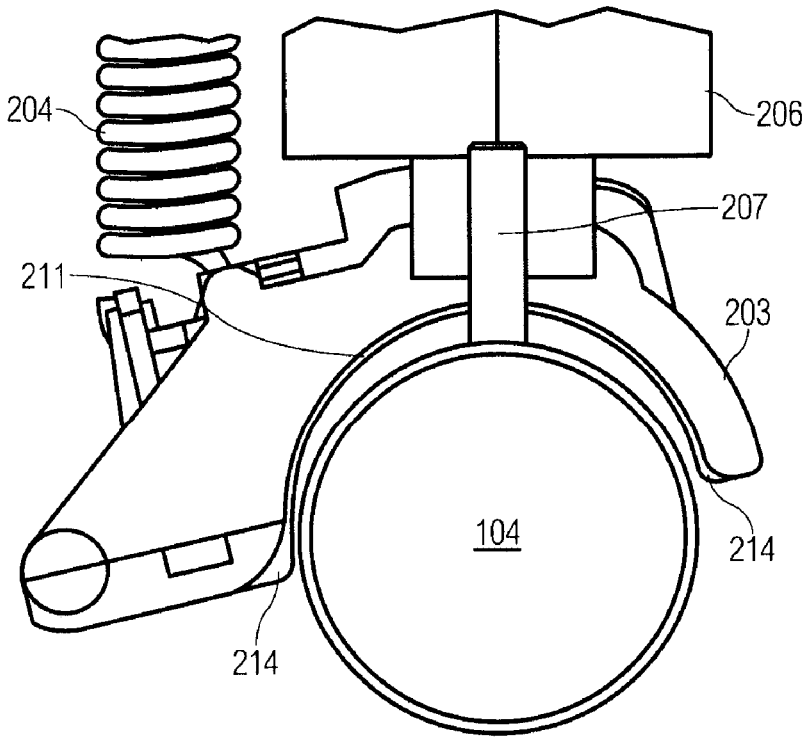
FIG. 2*c* shows an enlarged view of the cross-sectional view of the second assembly as shown in FIG. 2*b*.

Each of the cams 202 has a predefined profile 210. The predefined profile 210 of each cam 202 is in a series of steps corresponding to the various PPS settings in an embodiment. The predefined profile 210 or the number of steps may vary to achieve different PPS settings in other embodiments. The bushing member 203 has a first surface 211 facing the guiding rod. The first surface 211 have one or more flat portions 214 which abut or touch the surface of the guiding rod 104. The flat portions 214 which extend from the first surface 211 can be seen more clearly in FIG. 2*c*, which is an enlarged view of the bushing member 203 of FIG. 2*b*.

The protruding members 213 extend from a second surface 212 of the bushing member 203. Each protruding member 213 is provided for each cam 202, and abuts the profile 210 of the cam 202. The bushing member 203 is slidable along the guiding rod 104, and hence, moves the carriage 103 attached to the camshaft 201 along the guiding rod 104. The protruding members 213, and hence the bushing member 203, are biased against the cams 202 by the two springs 204. One end of the springs 204 is attached to the bushing member 203, and the other end is attached (not shown) to the carriage 103.

The connecting plate 205 is attached to a first end of the camshaft 201, and the pin engaging means 206 is attached to the connecting plate 205. The pin engaging means 206 is rotatable with respect to the connecting plate 205 about an axis parallel to the longitudinal axis of the camshaft 201. The connecting plate 205 includes a locking member 208, and the pin engaging means 206 includes a complementary member 209. When the pin engaging means 206 is at its default position (i.e. not rotated with respect to the connecting plate 205), the locking member 208 interlocks with the complementary member 209. It should be noted that the interlocking of the pin engaging means 206 with the connecting plate 205 does not prevent the pin engaging means 206 from rotating with respect to the connecting plate 205. In an embodiment, the pin engaging means 206 is biased to its default position. The pin engaging means 206 may be biased to its default position using a biasing means such as a spring.

Figure 3:
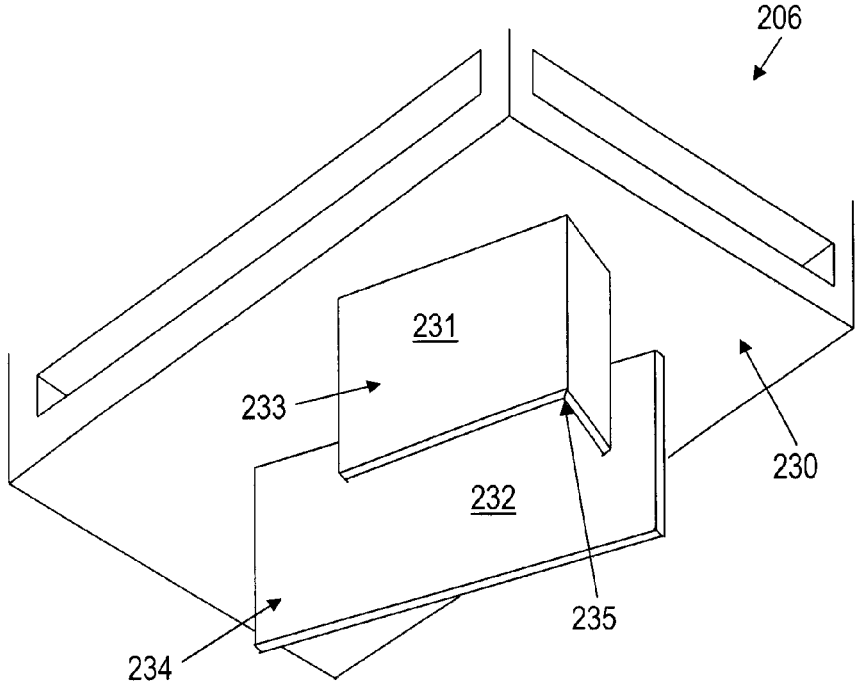
FIG. 3 shows a first rib and a second rib extending from the underside of a pin engaging means of the carriage according to an embodiment.

In an embodiment, the pin engaging means 206 includes a first rib 231 and a second rib 232 extending from its underside 230 as shown in FIG. 3. The first rib 231 is in the form of a bracket and subtends an acute angle for engaging the activation pin 207. The second rib 232 is in the form of a plate. In this embodiment, the second rib 232 has a length which is slightly longer than that of the first rib 231. The mechanism of engaging and disengaging the activation pin 207 by the pin engaging means 206 will be described in detail later.

Figure 4A:
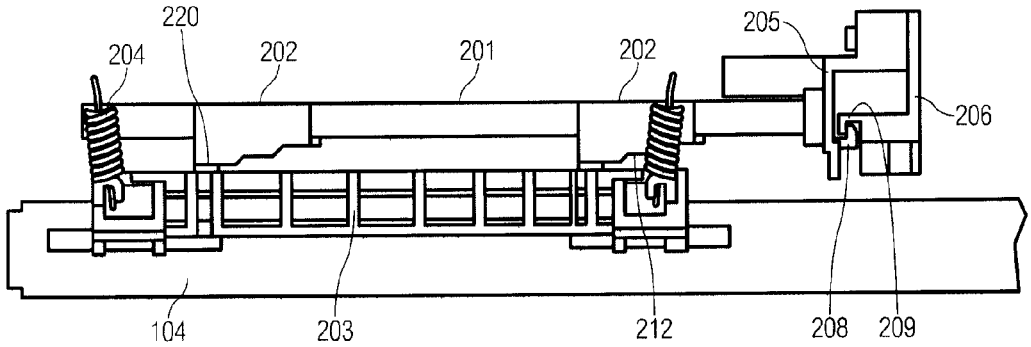
FIG. 4*a* and FIG. 4*b* show the cross-sectional views of the second assembly with a camshaft shifted to the right of a carriage according to an embodiment
Figure 4B:
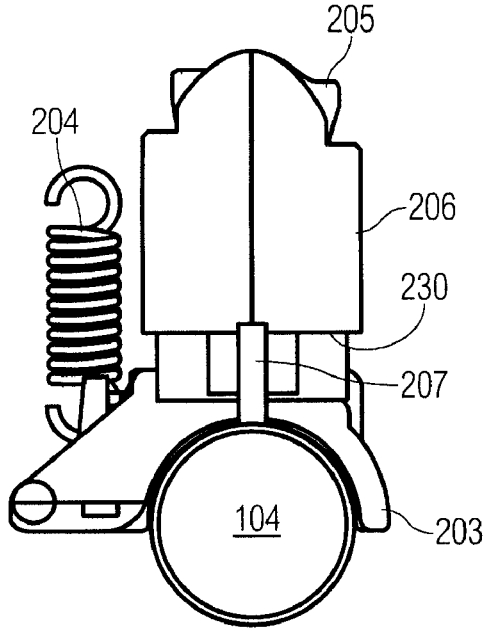

FIGS. 4*a* and 4*b* show the cross-sectional views of the second assembly 102 with the camshaft shifted to the right (i.e. towards the first end) of the guiding rod 104 according to an embodiment. It can be seen that the protruding members 213 of the bushing member 203 abut the profile of the cams 212 at its furthest point 220. Therefore, the protruding members 213 push the camshaft 201 away when the camshaft 201 is shifted to the right. Accordingly, the central portion of the carriage 103 attached to the camshaft 201 is lifted from the guiding rod 104. The carriage 103 can be lowered back to its original position by shifting the camshaft 201 to the left with respect to the carriage 103, i.e. away from the first end of the guiding rod 104.

Figure 5A:
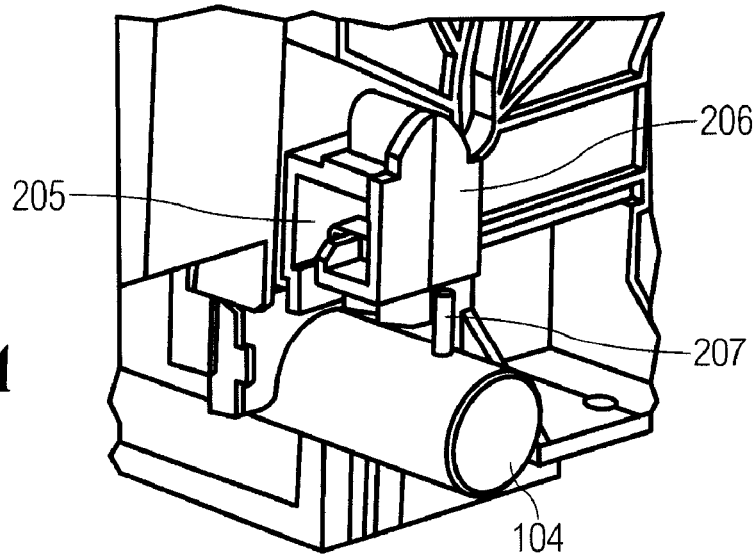
FIG. 5*a* to FIG. 5*c* show the various stages of the pin engaging means engaging an activation pin on the guiding rod according to an embodiment.
Figure 5B:
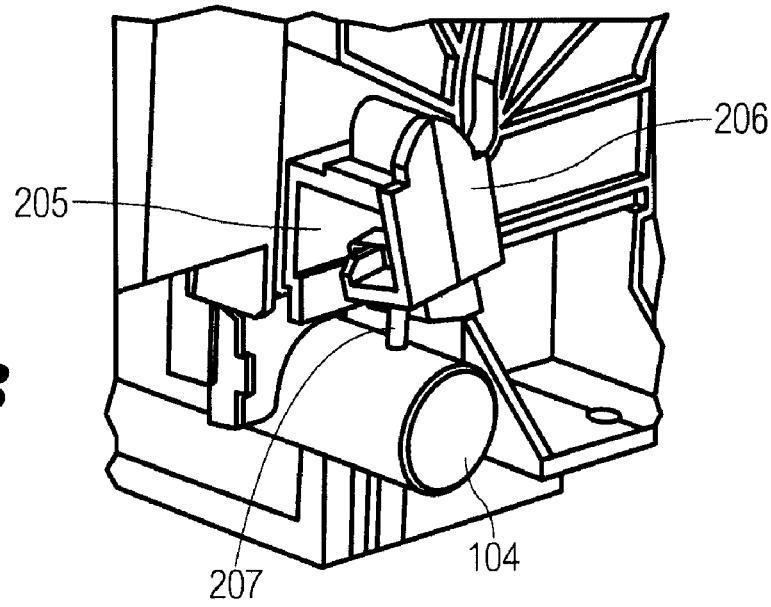
Figure 5C:
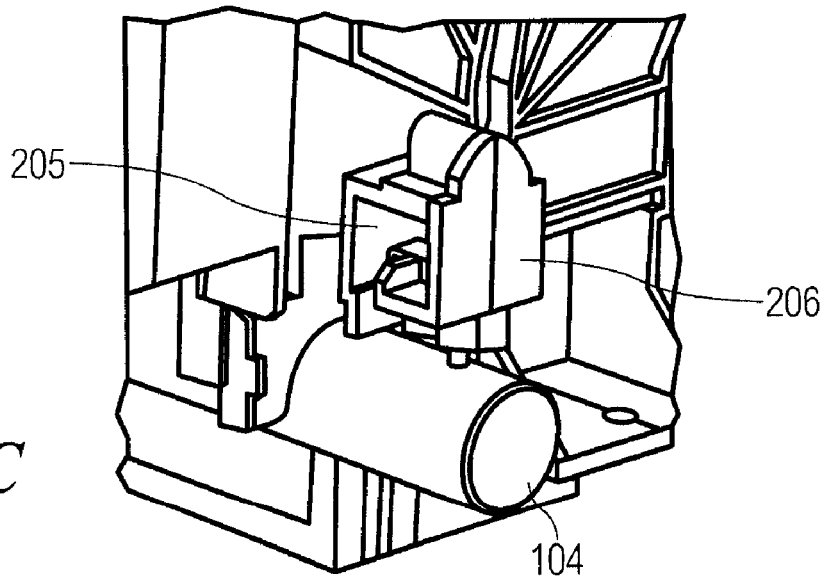

The operation of the pin engaging means 206 shall now be described in detail with reference to FIG. 3 and FIG. 5*a*-5*c*. To engage the activation pin 207, the carriage 103 is moved towards the first end (to the right) of the guiding rod 104 where the activation pin 207 is located, as shown in FIG. 5*a*. When the activation pin 207 contacts a first surface 233 of the first rib 231, the activation pin 207 pushes the first rib 231 and causes the pin engaging means 206 to rotate in a counter-clockwise direction when seen from the first end of the guiding rod 104 as shown in FIG. 5*b*. When the carriage 103 moves further towards the first end, the pin engaging means 206 rotates in the clockwise direction back to its original position (e.g. by a biasing spring) as shown in FIG. 5*c*. At this position, the activation pin 207 is located between the first and second ribs 231, 232, and the pin engaging means 206 is interlocked with the connecting plate 205.

When the carriage 103 moves away from the first end of the guiding rod 104, the activation pin 207 is engaged or "trapped" at a corner 235 of the first rib 231, at an opposite surface from the first surface 233 where the acute angle is subtended. By moving the carriage 103 further away from the first end, the activation pin 207 engaged in the pin engaging means 206 pulls the camshaft 201, and hence, slides the camshaft 201 towards the first end with respect to the carriage 103.

To disengage the activation pin 207 from the pin engaging means 206, the carriage 103 is moved towards the first end of the guiding rod 104 such that the activation pin 207 contacts a first surface 234 of the second rib 232. When the carriage 103 continues to move towards the first end, the activation pin 207 pushes the second rib 232 and causes the pin engaging means 206 to rotate in the counter-clockwise direction. When the carriage 103 moves further towards the first end, the pin engaging means 206 rotates back to its original position with the activation pin 207 located between the second rib 232 and the connecting plate 205. By moving the carriage 103 away from the first end, the activation pin 207 pushes an opposite surface of the second rib 232 and causes the pin engaging means 206 to rotate in the clockwise direction. When the carriage 103 further moves away from the first end, the activation pin 207 is disengaged from the pin engaging means 206. The pin engaging means 206 rotates in the clockwise direction back to its original position when the activation pin 207 is disengaged from the pin engaging means 206.

The position of the camshaft 201 may also be reset to its original position with respect to the carriage 103 by moving the carriage 103 to the first end of the guiding rod 104 until the activation pin 207 pushes the connecting plate 205 and causes the camshaft 201 to slide to the left (i.e. away from the first end) with respect to the carriage 103.

Figure 6:
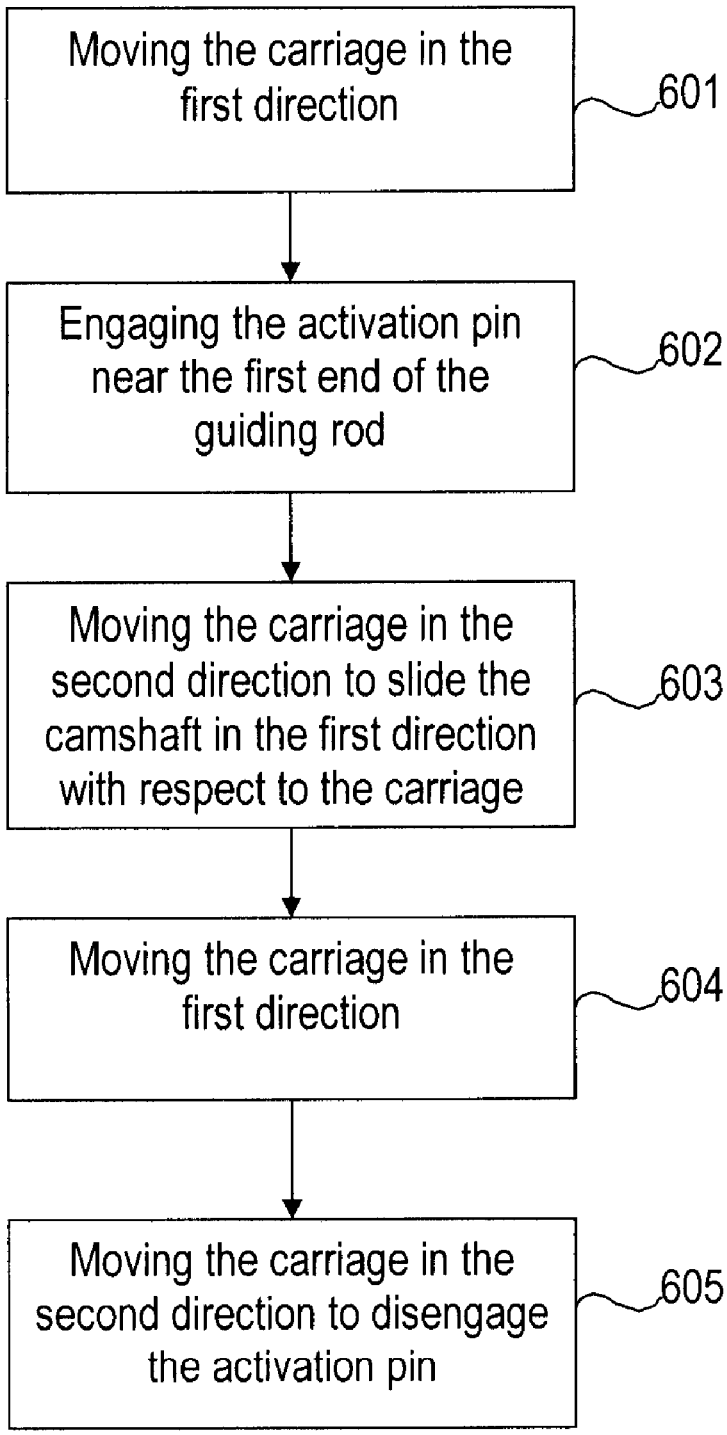
FIG. 6 shows a flow chart of a process for adjusting a position of a central portion of the carriage according to an embodiment.

FIG. 6 shows a flow chart of a process for adjusting the position of the central portion of the carriage 103 according to an embodiment. FIG. 7*a*-7*e* show the underside view of the position of the carriage 103, the camshaft 201 and the pin engaging means 206 with respect to the activation pin 207 corresponding to the flow chart of FIG. 6. The process for adjusting the position of the central portion of the carriage 103 shall be described in conjunction with FIG. 6 and FIG. 7*a*-7*e*.

Figure 7A:
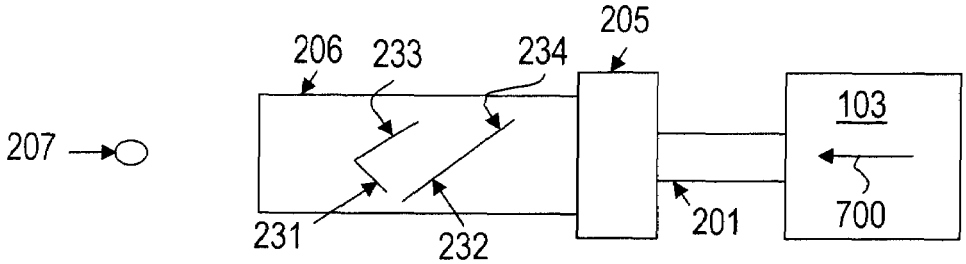
FIG. 7*a* to FIG. 7*e* show an underside view of the positions of the carriage, a camshaft and the pin engaging means with respect to the activation pin corresponding to the flow chart of FIG. 6 according to an embodiment.
Figure 7B:
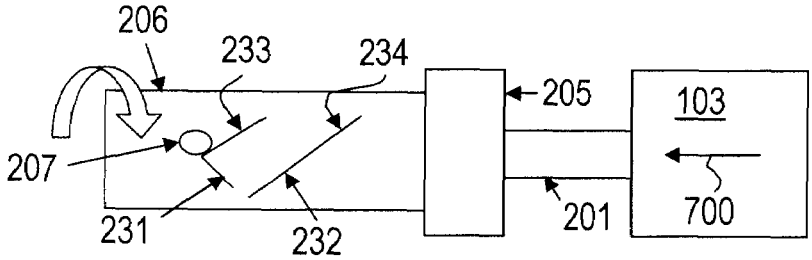

Step 601 includes moving the carriage 103 in a first direction towards the first end of the guiding rod 104 where the activation pin 207 is located. FIG. 7*a* shows the carriage 103 moving towards the activation pin 207. The arrow 700 inside the carriage 103 indicates the direction of movement of the carriage 103. Step 602 includes engaging the activation pin 207 located near the first end of the guiding rod 104 by the pin engaging means 206. The activation pin 207 pushes the first surface 233 of the first rib 231 of the pin engaging means 206 as the carriage 103 moves in the first direction as shown in FIG. 7*b*. As a result, the pin engaging means 206 is rotated in the counter-clockwise direction with respect to the connecting plate 205 to allow the activation pin 207 to be trapped between the first rib 231 and the second rib 232 of the pin engaging means 206.

Figure 7C:
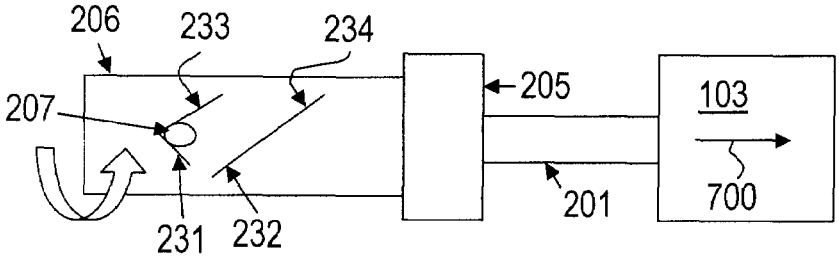

Step 603 includes moving the carriage 103 in a second direction away from the first end to slide the camshaft 201 in the first direction (i.e. to the left) with respect to the carriage 103. When the carriage 103 moves in the second direction, the activation pin 207 is trapped at the surface opposite from the first surface 233 of the first rib 231. As the activation pin 207 is engaged or trapped by the first rib 231 at the opposite surface, the pin engaging means 206, the connecting plate 205 and the camshaft 210 are therefore prevented from moving in the second direction. Accordingly, when the carriage 103 moves in the second direction, the camshaft 201 is slided in the first direction with respect to the carriage 103 as shown in FIG. 7*c*.

Figure 7D:
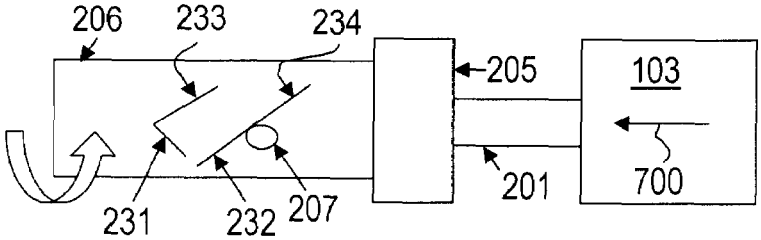

Step 604 includes moving the carriage 103 in the first direction. In this step, the activation pin 207 pushes the first surface 234 of the second rib 232 as the carriage 103 moves in the first direction. As a result, the pin engaging means 206 is rotated in the counter-clockwise direction with respect to the connecting plate 205 such that the activation pin 207 is located between the second rib 232 and the connecting plate 205 as shown in FIG. 7*d*.

Figure 7E:
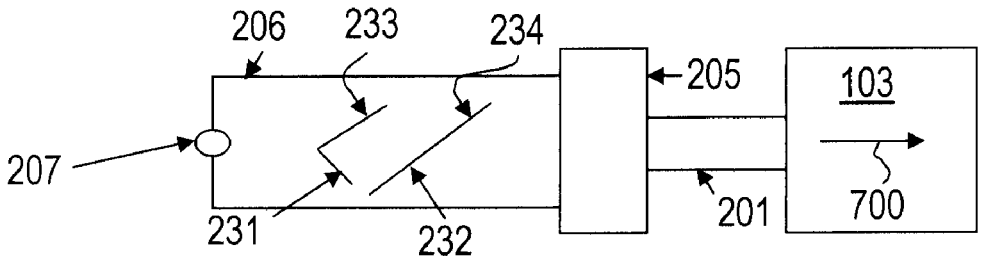

Step 605 includes moving the carriage 103 in the second direction to disengage the activation pin from the pin engaging means 206. When the carriage 103 moves in the second direction, the activation pin 207 pushes the surface opposite from the first surface 234 of the second rib 232. As a result, the pin engaging means 206 is rotated in the clockwise direction with respect to the connecting plate 205 such that the activation pin is completely disengaged from the engaging means 206 as shown in FIG. 7*e*. At this stage, the position of the carriage 103 has been adjusted and may proceed for performing a printing operation.

Figure 8:
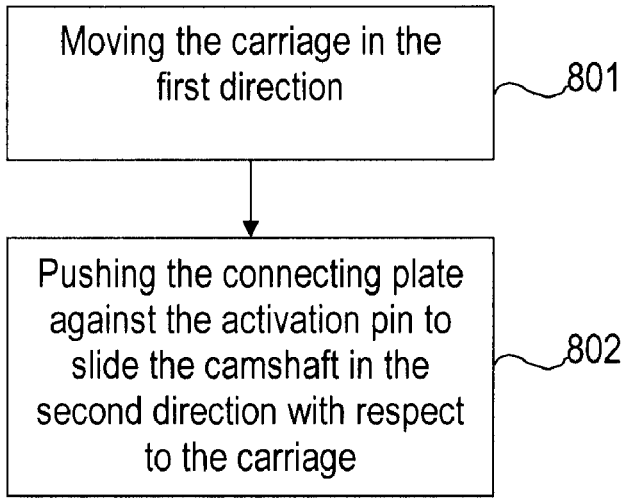
FIG. 8 shows a flow chart of a process for sliding the camshaft in the second direction according to an embodiment.

After adjusting the position of the central portion of the carriage 103, the position of the carriage 103 may be further adjusted to another position by sliding the camshaft 201 in the first direction or the second direction with respect to the carriage 103. The process of sliding the camshaft 201 in the first direction has already been described above in FIG. 6. FIG. 8 shows a flow chart of a process for sliding the camshaft 201 in the second direction according to an embodiment.

Step 801 includes moving the carriage 103 in the first direction until the connecting plate 205 is in contact with the activation pin 207. Step 802 includes pushing the connecting plate 205 against the activation pin 207. As a result, the camshaft 201 is slided in the second direction with respect to the carriage 103.

Figure 9A:
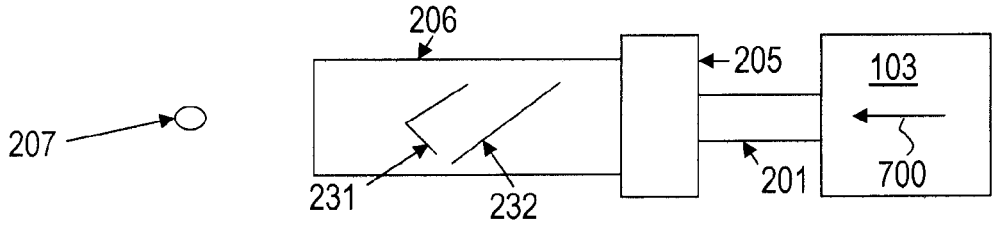
FIG. 9*a* to FIG. 9*e* show the positions of the carriage, the camshaft and the pin engaging means with respect to the activation pin corresponding to the flow chart of FIG. 8 according to an embodiment.
Figure 9B:
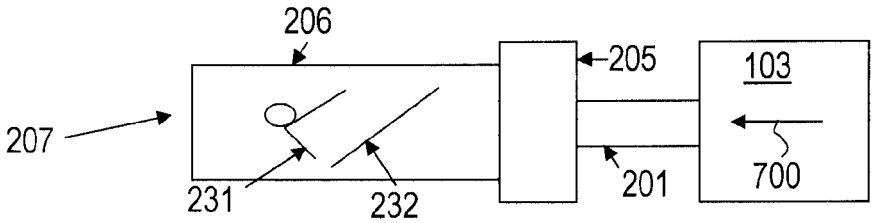
Figure 9C:
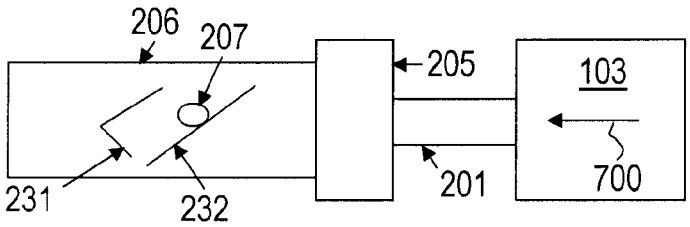

FIG. 9*a*-9*e* show the positions of the carriage 103, the camshaft 201 and the pin engaging means 206 with respect to the activation pin 207 corresponding to the flow chart of FIG. 8. FIG. 9*a* shows the carriage 103 moving in the first direction towards the activation pin 207. The activation pin 207 pushes the first rib 231 of the pin engaging means 206 and causes the pin engaging means 206 to rotate in the counter-clockwise direction as shown in FIG. 9*b*. The pin engaging means 206 returns to its original position by rotating in the clockwise direction when the activation pin 207 is between the first rib 231 and the second rib 232 as shown in FIG. 9*c*.

As the carriage continues to move in the first direction, the activation pin 207 pushes the second rib 232, and causes the pin engaging means 206 to rotate in the counter-clockwise direction. Similarly, the pin engaging means 206 returns to its original position by rotating in the clockwise direction when the activation pin 207 is between the second rib 232 and the connecting plate 205.

Figure 9D:
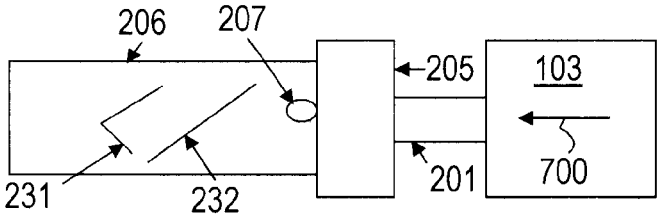
Figure 9E:
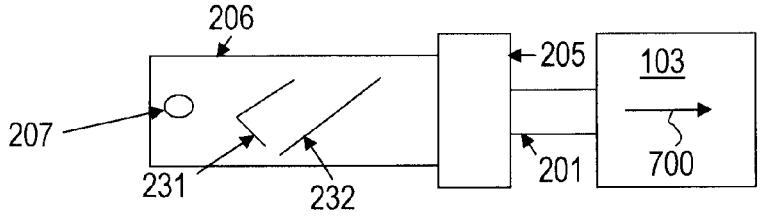

As the carriage continues to move in the first direction, the connecting plate 205 contacts the activation pin 207 and is prevented from further movement in the first direction. As a result, the camshaft 201 is slided in the second direction with respect to the carriage 103 as shown in FIG. 9*d*. Thereafter, the carriage 103 moves in the second direction. As the carriage 103 moves in the second direction, the pin engaging means 206 is rotated by the activation pin 207 in the clockwise direction. Accordingly, the activation pin 207 is disengaged from the pin engaging means 206 as shown in FIG. 9*e*.

The sliding of the camshaft 201 in the second direction with respect to the carriage 103 as described in FIG. 8 and FIG. 9*a*-9*e* is used for resetting the position of the carriage 103 to its original vertical position in an embodiment. In another embodiment, the sliding of the camshaft 201 in the second direction with respect to the carriage 103 is used for lowering the vertical position of the carriage 103 to another predefined position.

In an embodiment, when changing the vertical position of the central portion of carriage 103 from a first position to a second position, the position of the carriage 103 may first be reset to its original position from the first position, and then adjusted to the second position from the original position. By resetting the vertical position of the central portion of the carriage 103 to its original position prior to adjusting to a next position, the position of the carriage 103 at any point of time can be easily determined by the printer. In should be noted that the vertical position of the carriage 103 may also be adjusted directly from the first position to the second position in an alternative embodiment.

Figure 10:
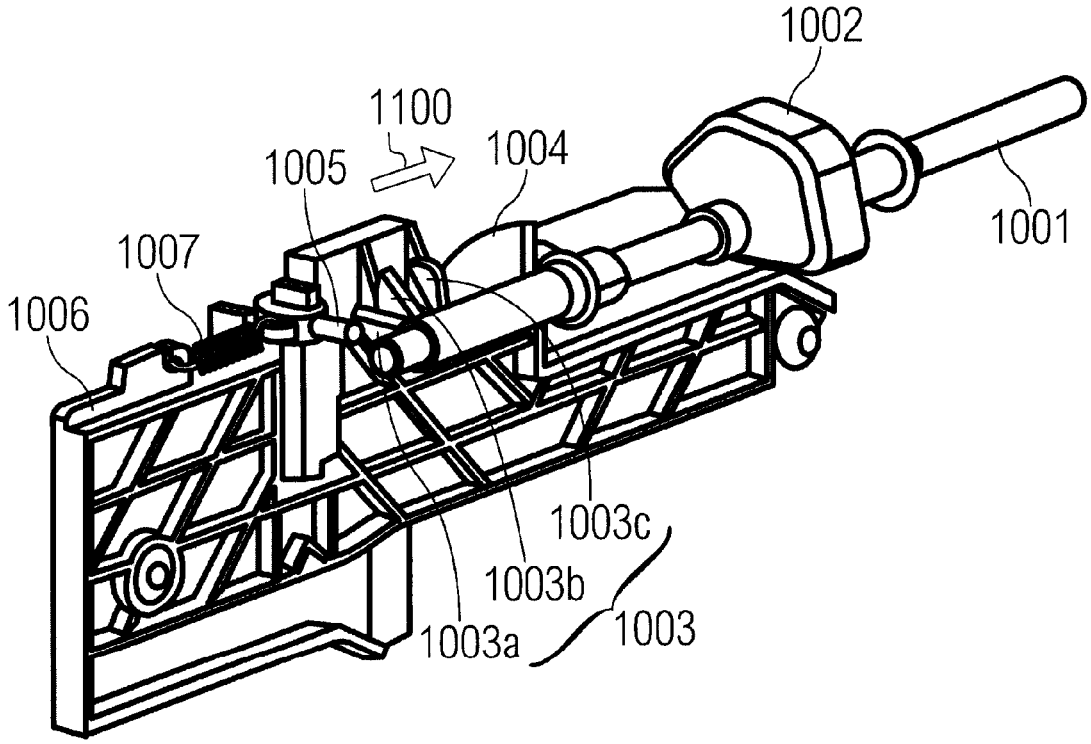
FIG. 10 shows the first assembly for adjusting a position of a rear portion of the carriage according to an embodiment.

FIG. 10 shows the first assembly 101 for adjusting a position of the rear portion of the carriage 103 according to an embodiment. The first assembly 101 includes a rear camshaft 1001, a rear cam 1002, rotation ribs 1003 and a reset rib 1004. The rear cam 1002, rotation ribs 1003 and the reset rib 1004 are attached to the rear camshaft 1001 and are rotatable together with the camshaft 1001. A rotation pin 1005 is provided from a rear plate 1006 of the printer, and is adapted to rotate the rear camshaft 1001 by engaging the rotation ribs 1003 or the reset rib 1004.

In the embodiment of the first assembly 101 shown in FIG. 10, there are three parallel rotation ribs 1003*a*, 1003*b*, 1003*c*. When the rotation pin 1005 engages each rotation rib 1003, the rear camshaft 1001 is rotated by a predefined angle in the clockwise direction. The reset rib 1004, when engaged by the rotation pin 1005, resets the vertical position of the rear camshaft 1001 by rotating the rear camshaft 1001 in the counter-clockwise direction.

The rotation pin 1005 is pivoted at the rear plate 1006 such that it can be tilted in the second direction shown by the arrow 1100 (i.e. the direction away from the activation pin 207). The rotation pin 1005 is attached to a rear spring 1007 to bias the rotation pin 1005 back to its original position when the rotation pin 105 is tilted towards the second direction.

Figure 11A:
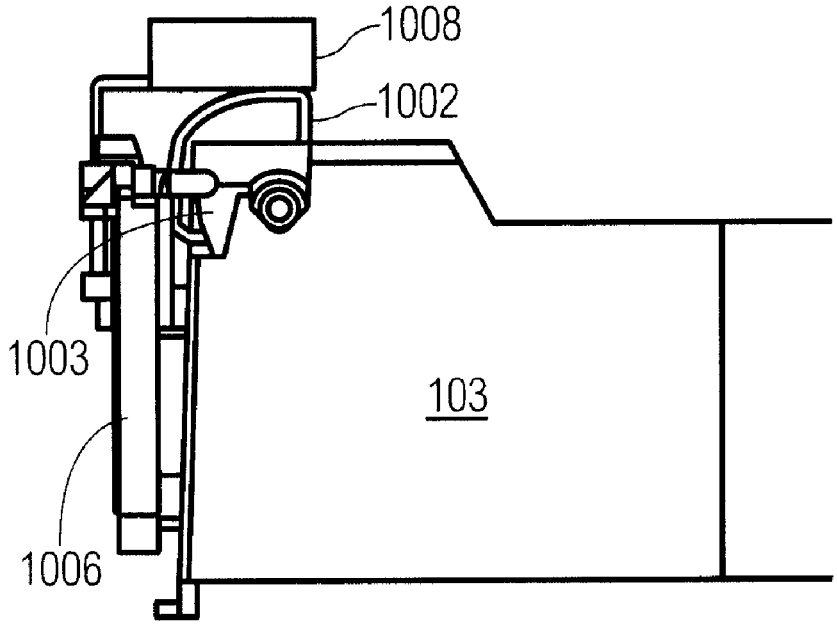
FIG. 11*a* and FIG. 11*b* show the rear portion of the carriage being biased towards a top plate of the printer such that a rear cam of the first assembly abuts the top plate according to an embodiment.
Figure 11B:
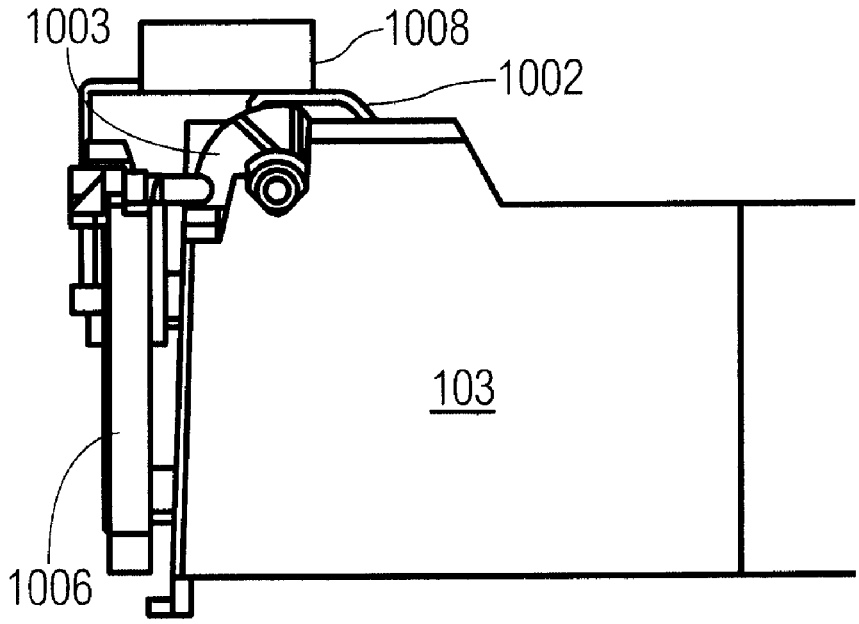

The rear portion of the carriage 103 is biased towards a top plate 1008 such that the rear cam 1002 abuts the top plate 1008, as shown in FIG. 11*a*-11*b*. The rear cam 1002 has a predefined profile such that the distance between the rear camshaft 1001 and the top plate 1008 changes when the rear camshaft 1001 is rotated. FIG. 11*a* shows the position of the rear cam 1002 when the rear camshaft 1001 is at its original position. FIG. 11*b* shows the position of the rear cam 1002 when the rear camshaft 1001 is rotated in the counter-clockwise direction to an end position.

Figure 12:
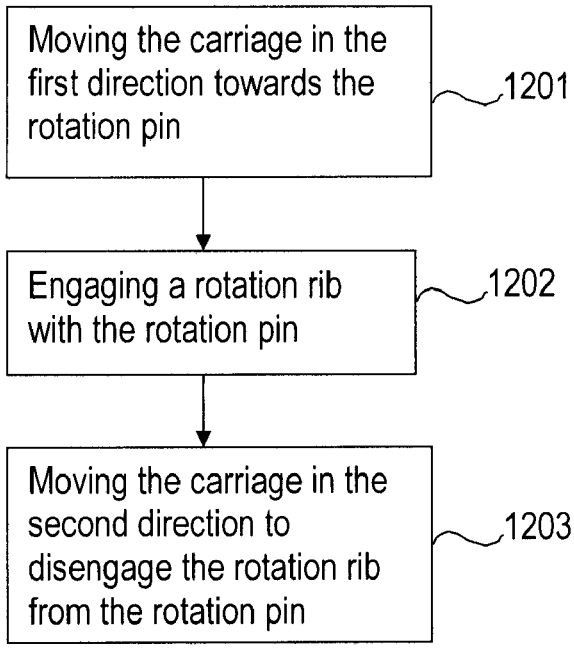
FIG. 12 shows a flow chart of a process for adjusting the position of the rear portion of the carriage according to an embodiment.

FIG. 12 shows a flow chart of the process for adjusting the position of the rear portion of the carriage 103 according to an embodiment. Step 1201 includes moving the carriage 103 in the first direction towards the rotation pin 1005. The carriage 103 is moved in the first direction in the same way for adjusting the position of the central portion of the carriage 103 as described above. Step 1202 includes engaging one of the rotation ribs 1003 with the rotation pin 1005. The rotation pin 1005 contacts one surface of the rotation rib 1003. When the carriage 103 continues to move in the first direction, the rotation pin 1005 engaged at the surface of the rotation rib 1003 causes the rear camshaft 1001 to rotate in the clockwise direction. The carriage 103 moves in the first direction until the rotation pin 1005 is located between the rotation rib 1003 and the reset rib 1004.

Step 1203 includes moving the carriage 103 in the second direction to disengage the rotation rib 1003 from the rotation pin 1005. As the carriage 103 moves in the second direction, the rotation pin 1005 contacts the other surface of the rotation rib 1003. When the carriage 103 continues to move in the second direction, the rotation rib 1005 is tilted towards the second direction by the rotation rib 1003 and the rotation rib 1003 is disengaged from the rotation pin 1005. When the rotation rib 1003 is disengaged from the rotation pin 1005, the rotation pin 1005 is restored to its original position by the rear spring 1007.

In the embodiment where three rotation ribs 1003*a*, 1003*b*, 1003*c* are used, three or more stages of rear camshaft 1001 rotation corresponding to three or more vertical positions of the rear portion of the carriage 103 can be predefined. The process described in the flow chart of FIG. 12 may be used to adjust the position of the rear portion of the carriage 103 by a first amount corresponding to a first stage of the rear camshaft 1001 rotation. In this case, the first rotation rib 1003*a* is engaged with the rotation pin 1005 to rotate the rear camshaft 1001. Thereafter, the process described in the flow chart of FIG. 12 may be repeated to adjust the position of the rear portion of the carriage 103 by a second amount corresponding to a second stage of the rear camshaft 1001 rotation. This is because as the carriage 103 moves in the first direction again, the second rotation rib 1003*b* engages the rotation pin 1005, and causes the rear camshaft 1001 to rotate further in the counter-clockwise direction. Similarly, the position of the rear portion of the carriage 103 may be adjusted by a third amount corresponding to a third stage of the rear camshaft 1001 rotation. The position of the rear portion of the carriage 103 is adjusted by the third amount by engaging the third rotation rib 1003*c* with the rotation pin 1005.

Figure 13:
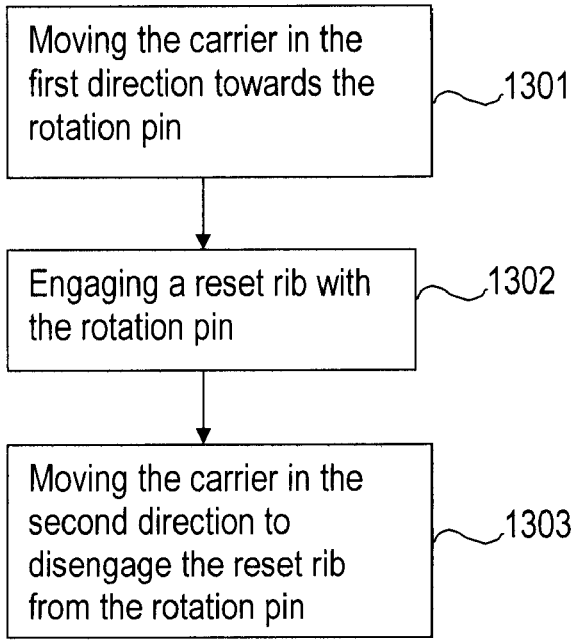
FIG. 13 shows a flow chart of a process for resetting the position of the rear portion of the carriage according to an embodiment.

FIG. 13 shows a flow chart of a process for resetting the vertical position of the rear portion of the carriage 103 according to an embodiment. Step 1301 includes moving the carriage 103 in the first direction towards the rotation pin 1005. Step 1302 includes engaging the reset rib 1004 with the rotation pin 1005. Specifically, the rotation pin 1005 contacts a first surface of the reset rib 1004. When the carriage 103 continues to move in the first direction, the rotation pin 1005 at the first surface of the reset rib 1004 causes the rear camshaft 1001 to rotate in the counter-clockwise direction to its original position.

When the carriage 103 moves in the first direction, the rotation pin 1005 may first contact the rotation rib 1003, for example the first, second or third rotation rib 1003*a*, 1003*b*, 1003*c* before contacting the reset rib 1004. In this case, the rotation pin 1005 would cause the rear camshaft 1001 to first rotate in the clockwise direction before contacting the reset rib 1004.

Step 1303 includes moving the carriage 103 in the second direction to disengage the reset rib 1004 from the rotation pin 1005. Similarly, as the carriage 103 moves in the second direction, the rotation pin 1005 contacts the reset rib 1004 and the rotation rib 1003. Accordingly, the rotation rib 1005 is tilted towards the second direction by the reset rib 1004 and the rotation rib 1003 as they move pass the rotation pin 105. The rotation rib 1003 is subsequently restored to its original position by the rear spring 1007.

The position of the rear portion of the carriage 103 may be adjusted from a first vertical position to a second vertical position directly in one embodiment. In another embodiment, the vertical position of the rear portion of the carriage 103 is first reset to its original position before adjusting to another predefined position. The resetting of the rear portion of the carriage 103 to the original position allows the vertical position of the rear portion of the carriage 103 to be determined by the printer at any time.

Figure 14A:
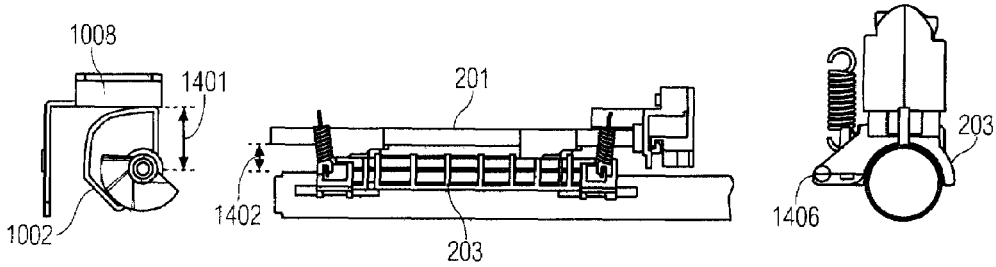
FIG. 14*a* to FIG. 14*d* show an example of a 4-stage PPS settings according to an embodiment.

FIG. 14*a*-14*d* show an example of a 4-stage PPS setting according to an embodiment. FIG. 14*a* shows a first stage setting (Stage 1) with the PPS predefined at 1.2 mm. At Stage 1, all parts of the first assembly 101 and the second assembly 102 are at their default positions. Specifically, the rear camshaft 1001 is at its most counter-clockwise position, and the camshaft 201 is at the position where the distance 1402 between the camshaft 201 and the bushing member 203 is the smallest.

Figure 14B:
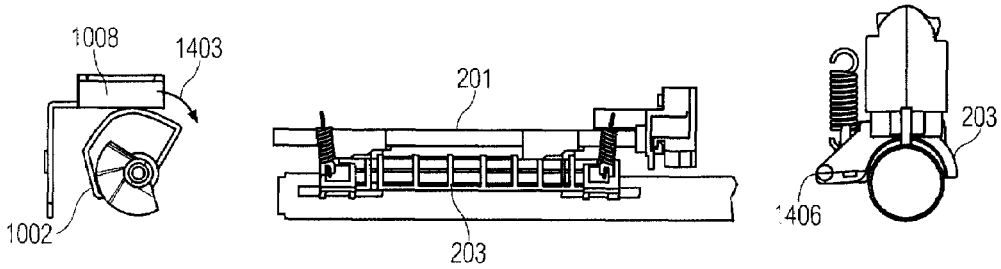

FIG. 14*b* shows a second stage setting (Stage 2). At Stage 2, the rear camshaft 1001 is rotated approximately 45 degrees from its default position in the clockwise direction as shown by arrow 1403. In this example, the profile of the rear cam 1002 is predefined in such a way that the distance 1401 between the top plate 1008 and the rear camshaft 1001 increases when the rear camshaft 1001 is rotated from its position at Stage 1 to Stage 2. The position of the camshaft 201 remains unchanged. As a result, the carriage 103 is tilted in the counter-clockwise direction at an angle of 0.476 degrees, resulting in the PPS to increase to 1.5 mm.

Figure 14C:
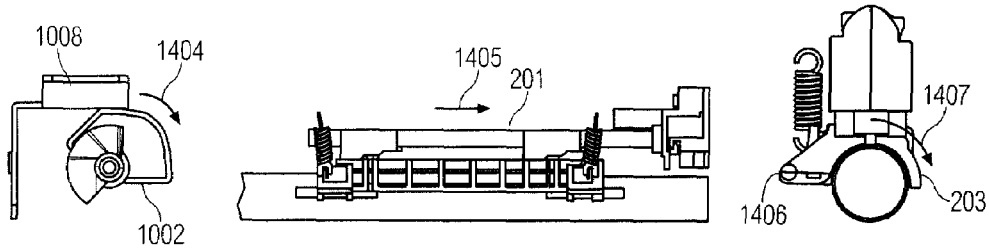

FIG. 14*c* shows a third stage setting (Stage 3). At Stage 3, the rear camshaft 1001 is rotated approximately 90 degrees from its default position in the clockwise direction as shown by arrow 1404. As a result, the distance 1401 between the rear camshaft 1001 and the top plate 1008 is decreased. Additionally, the camshaft 201 is also slided approximately 4.26 mm in the first direction with respect to the carriage 103 as shown by arrow 1405. Accordingly, the bushing member 203 is pushed away from the camshaft 201 by the cam 202. The bushing member 203 in this embodiment is pivoted at a first end 1406. This results in the bushing member 203 to rotate approximately 5.5066 degrees in the clockwise direction as shown by arrow 1407. In this Stage 3, both the rear and the central portion of the carriage 103 are lifted, resulting in the PPS to increase to 1.9 mm, with theta X maintained at 0 degrees.

Figure 14D:
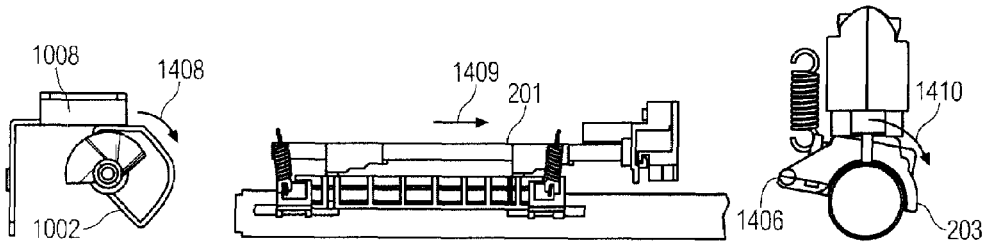

FIG. 14*d* shows a fourth stage setting (Stage 4). At Stage 4, the rear camshaft 1001 is rotated approximately 135 degrees from its default position in the clockwise direction as shown by arrow 1408. As a result, the distance 1401 between the rear camshaft 1001 and the top plate 1008 is decreased. Additionally, the camshaft 201 is also slided approximately 10.26 mm in the first direction with respect to the carriage 103 as shown by arrow 1409. Accordingly, the bushing member 203 is rotated approximately 7.5064 degrees in the clockwise direction as shown by arrow 1410. In this Stage 4, both the rear and the central portion of the carriage 103 are lifted, resulting in the PPS to increase to 3.9 mm, with theta X maintained at 0 degree.

It should be noted that the 4-stage setting described above is only an example. It is possible to have a different number of stages corresponding to different PPS values. Also, it is possible to rotate the rear camshaft 1001 and slide the camshaft 201 by different amounts to achieve different desired PPS values.

Although the present invention has been described in accordance with the embodiments as shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. An apparatus for adjusting a spacing between a printhead in a printer and a print medium advanced through the printer, wherein the printhead is mounted in a carriage which is movable along a guiding rod, the apparatus comprising:

a first assembly for adjusting a position of a first portion of the carriage; and a second assembly for adjusting a position of a second portion of the carriage, wherein the second assembly comprises:

a camshaft attached to the carriage and is movable with respect thereto;

at least one cam attached to the camshaft, the cam having a predefined profile;

a bushing member having a first member which abuts the predefined profile of the cam and a second member which abuts the guiding rod;

an activation pin near a first end on the guiding rod;

a pin engaging means at the first end of the camshaft for engaging the activation pin; and a connecting plate attached between the first end of the camshaft and the pin engaging means, the pin engaging means is rotatable with respect to the connecting plate, wherein the moving of the camshaft with respect to the carriage causes a distance between the bushing member and the camshaft to vary according to the predefined profile of the cam, thereby adjusting the spacing between the printhead and the print medium.

2. An apparatus for adjusting a spacing between a printhead in a printer and a print medium advanced through the printer, wherein the printhead is mounted in a carriage which is movable along a guiding rod, the apparatus comprising:

a first assembly for adjusting a position of a first portion of the carriage; and a second assembly for adjusting a position of a second portion of the carriage, wherein the second assembly comprises:

a camshaft attached to the carriage and is movable with respect thereto;

at least one cam attached to the camshaft, the cam having a predefined profile;

a bushing member having a first member which abuts the predefined profile of the cam and a second member which abuts the guiding rod;

an activation pin near a first end on the guiding rod; and a pin engaging means at the first end of the camshaft for engaging the activation pin, wherein the pin engaging means comprises a first guiding rib for engaging the activation pin in the pin engaging means, and a second guiding rib for disengaging the activation pin from the pin engaging means, and wherein the moving of the camshaft with respect to the carriage causes a distance between the bushing member and the camshaft to vary according to the predefined profile of the cam, thereby adjusting the spacing between the printhead and the print medium.

3. An apparatus for adjusting a spacing between a printhead in a printer and a print medium advanced through the printer, wherein the printhead is mounted in a carriage which is movable along a guiding rod, the apparatus comprising:

a first assembly for adjusting a position of a first portion of the carriage; and a second assembly for adjusting a position of a second portion of the carriage, wherein the first portion of the carriage is at a rear portion of the carriage and the second portion of the carriage is at a central portion of the carriage, wherein the first assembly comprises:

a rear camshaft attached to the carriage and is rotatable with respect thereto;

a rear cam attached to the camshaft, the rear cam having a predefined profile and is rotatable with the camshaft, the rotation of the rear camshaft causes a vertical position of the rear portion of the carriage to vary according to the predefined profile of the rear cam;

a rotation pin extending from a rear plate of the printer; and at least one rotation rib attached to the rear camshaft, wherein the at least one rotation rib is engageable with the rotation pin to rotate the rear camshaft, wherein the second assembly comprises:

a camshaft attached to the carriage and is movable with respect thereto;

at least one cam attached to the camshaft, the cam having a predefined profile; and a bushing member having a first member which abuts the predefined profile of the cam and a second member which abuts the guiding rod, wherein the moving of the camshaft with respect to the carriage causes a distance between the bushing member and the camshaft to vary according to the predefined profile of the cam, thereby adjusting the spacing between the printhead and the print medium.

4. The apparatus of claim 3 further comprises a reset rib attached to the rear camshaft, wherein the reset rib is engageable with the rotation pin to rotate the rear camshaft to reset the vertical position of the rear portion of the carriage.

5. The apparatus of claim 3, wherein the carriage is biased against a top plate of the printer such that the predefined profile of the rear cam abuts the top plate.

* * * * *

UNITED STATES PATENT AND TRADEMARK OFFICE

CERTIFICATE OF CORRECTION

PATENT NO. : 7,434,901 B2
APPLICATION NO. : 11/176045
DATED : October 14, 2008
INVENTOR(S) : Seng San Koh et al.

It is certified that error appears in the above-identified patent and that said Letters Patent is hereby corrected as shown below:

In column 11, line 15, in Claim 3, delete “wherein” before “the at least”.

Signed and Sealed this

Seventeenth Day of March, 2009

JOHN DOLL
*Acting Director of the United States Patent and Trademark Office*